US010059349B2

(12) United States Patent
Phadke

(10) Patent No.: US 10,059,349 B2
(45) Date of Patent: Aug. 28, 2018

(54) ROPEWAY VEHICLES

(71) Applicant: Sujay A. Phadke, Sunnyvale, CA (US)

(72) Inventor: Sujay A. Phadke, Sunnyvale, CA (US)

( * ) Notice: Subject to any disclaimer, the term of this patent is extended or adjusted under 35 U.S.C. 154(b) by 300 days.

(21) Appl. No.: 15/142,499

(22) Filed: Apr. 29, 2016

(65) Prior Publication Data

US 2017/0313328 A1 Nov. 2, 2017

(51) Int. Cl.
*B61C 13/06* (2006.01)
*B61C 3/00* (2006.01)
*B61B 3/02* (2006.01)

(52) U.S. Cl.
CPC ..... *B61C 3/00* (2013.01); *B61C 13/06* (2013.01); *B61B 3/02* (2013.01)

(58) Field of Classification Search
CPC .... B61B 7/00; B61B 7/06; B61B 3/02; B61B 12/02; B61B 12/002; B61B 3/00; B61C 13/04; B61C 13/06; B61C 3/00; B61C 11/02
USPC ..... 105/148, 149.1, 149.2, 150, 153, 30
See application file for complete search history.

(56) References Cited

U.S. PATENT DOCUMENTS

| | | | | |
|---|---|---|---|---|
| 110,971 | A | 1/1871 | Hallide | |
| 1,344,677 | A * | 6/1920 | Coanda | B61B 7/00 104/117 |
| 2,579,807 | A | 12/1951 | Egolf, Sr. | |
| 3,403,634 | A | 10/1968 | Crowder | |
| 3,498,236 | A * | 3/1970 | Meek | B61B 7/06 105/153 |
| 3,590,743 | A * | 7/1971 | Larson | B61B 3/02 104/125 |
| 3,759,185 | A | 9/1973 | Scherbatskoy | |
| 3,858,520 | A | 1/1975 | Patin | |
| 3,861,315 | A | 1/1975 | Rypinski | |
| 4,027,329 | A | 5/1977 | Coutta | |
| 4,732,087 | A | 3/1988 | Morishita et al. | |
| 4,791,871 | A * | 12/1988 | Mowll | B60L 5/40 104/88.02 |
| 5,156,093 | A | 10/1992 | Azukizawa et al. | |
| 5,450,320 | A | 9/1995 | Tsubaki et al. | |
| 5,562,040 | A | 10/1996 | Egli | |
| 6,155,766 | A | 12/2000 | Ostwald et al. | |
| 7,137,769 | B2 | 11/2006 | Komatsu et al. | |
| 8,199,197 | B2 | 6/2012 | Bennett et al. | |
| 8,920,251 | B2 | 12/2014 | Dietz et al. | |
| 9,096,294 | B1 | 8/2015 | Dong et al. | |
| 2004/0247416 | A1 | 12/2004 | Komatsu et al. | |
| 2010/0025160 | A1 | 2/2010 | Bojji et al. | |

(Continued)

FOREIGN PATENT DOCUMENTS

| | | | |
|---|---|---|---|
| CN | 2396936 | Y | 11/2009 |
| CN | 101992780 | A | 1/2011 |
| CN | 201694190 | U | 1/2011 |

(Continued)

*Primary Examiner* — Mark T Le
(74) *Attorney, Agent, or Firm* — Douglas L. Weller

(57) ABSTRACT

A ropeway vehicle is used within a ropeway vehicle transportation network. The ropeway vehicle includes at least one power drive wheel that is powered to move the ropeway vehicle along ropeway lines. At least one commutator wheel draws electrical power from ropeway cables that form the ropeway lines. A controller includes an on-board battery to back-up and supplement electrical power obtained from the ropeway cables.

20 Claims, 10 Drawing Sheets

(56) References Cited

U.S. PATENT DOCUMENTS

| | | | | |
|---|---|---|---|---|
| 2010/0242784 | A1* | 9/2010 | Oguro | H01L 21/67715 104/130.01 |
| 2016/0016593 | A1 | 1/2016 | Luger et al. | |

FOREIGN PATENT DOCUMENTS

| | | | |
|---|---|---|---|
| CN | 103738342 | A | 4/2014 |
| CN | 203681537 | U | 7/2014 |
| DE | 4127373 | A1 | 2/1993 |
| DE | 4334589 | A1 | 6/1994 |
| EP | 0671304 | B1 | 9/1999 |
| EP | 20070820161 | | 9/1999 |
| EP | 2115342 | A1 | 3/2008 |
| WO | WO2008031859 | A1 | 3/2008 |

* cited by examiner

ROPEWAY VEHICLES

BACKGROUND

Drone delivery allows low cost delivery of small light items. A delivery item may be attached to a drone that is programmed to fly to a delivery site. Drones have the advantage of avoiding traffic, and generally require less energy for a delivery than is require to deliver a package by a truck. A drone flight path can be scheduled to avoid heavily populated areas, restricted air space, and obstacles such as buildings or hills.

While drones offer promise for quick delivery in less populated areas, there are significant challenges for drones in heavily populated areas. In such places, a malfunction of a drone can be a safety hazard. Flight restrictions due to inclement weather of restricted air space can also limit the effectiveness of drones. Also, the energy required for flying puts limits on payload capacity, range and flight time of drones. When drones are battery powered, recharging or changing batteries can be inconvenient and/or time consuming.

DESCRIPTION OF THE EMBODIMENTS

Figure 1:
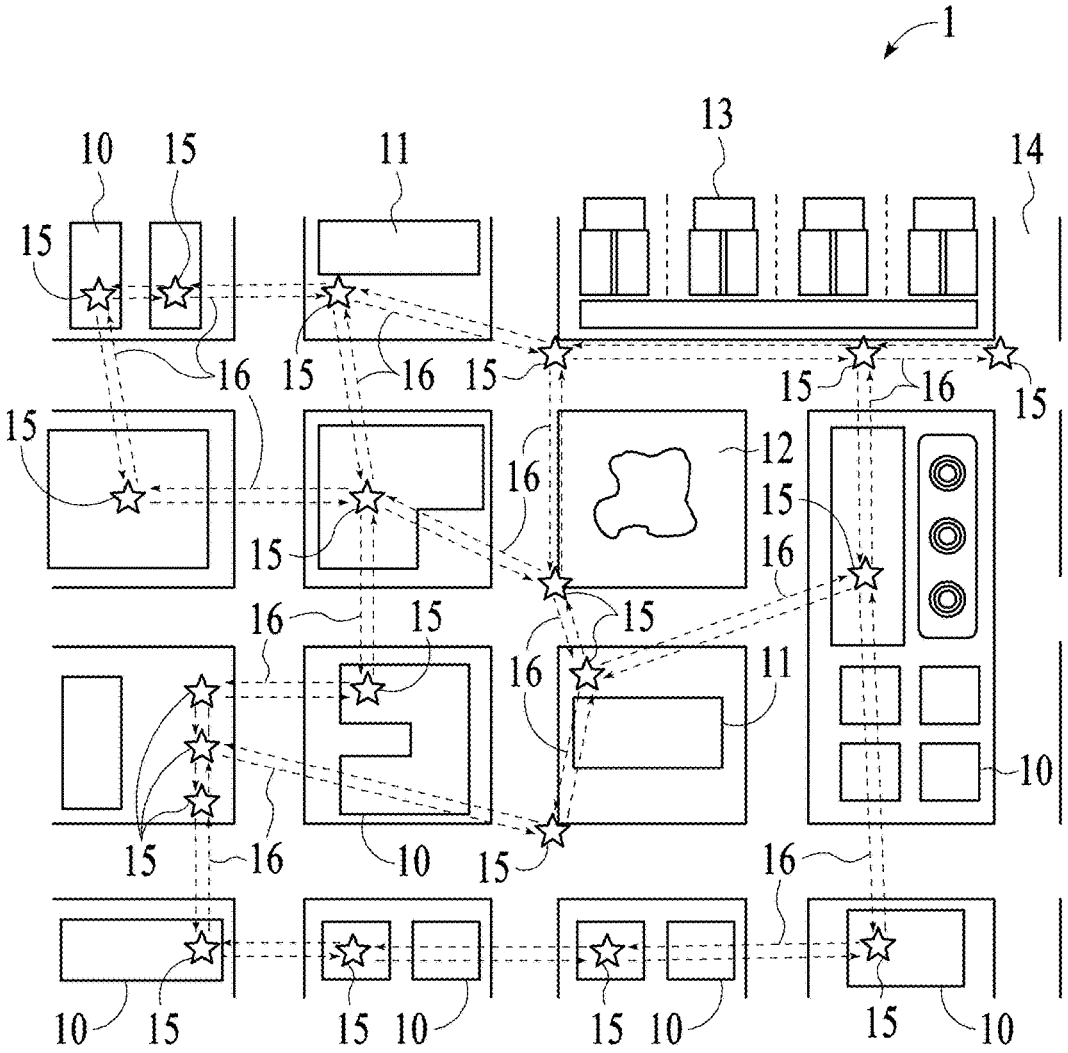
FIG. 1 is a simplified block diagram illustrating a ropeway vehicle transportation network in accordance with an implementation.

FIG. 1 shows an example of a ropeway vehicle transportation network system 1 that transports ropeway vehicles across an installed network in cities, rural areas, residential areas, farm lands, construction sites and so on. Ropeway vehicle transportation network system 1 can be implemented over varying locations and terrain.

For example, FIG. 1 shows ropeway vehicle transportation network system 1 networking office buildings 10, commercial shopping stores/centers 11, a public park 12, residential buildings 13, and a traffic pole 14. At each networked locations line stations 15 can be mounted that are line changer stations and/or drop-off/pick-up stations.

A ropeway line 16 connects each station 15. For example, each ropeway line 16 contains two structural cables that are designed to bear the weight of ropeway vehicles and their payloads. For example, each cable of ropeway line 16 is implemented using rope, coated steel cables, or any other type of cable capable of bearing weight required for the ropeway vehicle transportation network. While in the shown implementation each ropeway line 16 contains two structural cables, more or fewer structural cable s may be used to implement a ropeway line.

For example, each ropeway line 16 provides an electrical power source sufficient to power the ropeway vehicles. For example, the line changer stations all include anti-derail transition rails. For example, each ropeway vehicle includes anti-derail technology and commutator technology.

Ropeway vehicles can navigate freely within ropeway vehicle transportation network system 1. Ropeway vehicles can carry different types of payloads. For example, a payload can be any combination of security cameras, weather sensors, delivery packages, building glass cleaning systems, groceries, medicines, agricultural payloads, other types of packages, construction supplies, drones and so on.

A ropeway vehicle system network can be deployed over an agricultural field by deploying line changers atop poles fixed in the field. For example, a ropeway vehicle can spray pesticides, deliver seeds, harvest an agricultural field and also monitor crop condition in real time.

Figure 2:
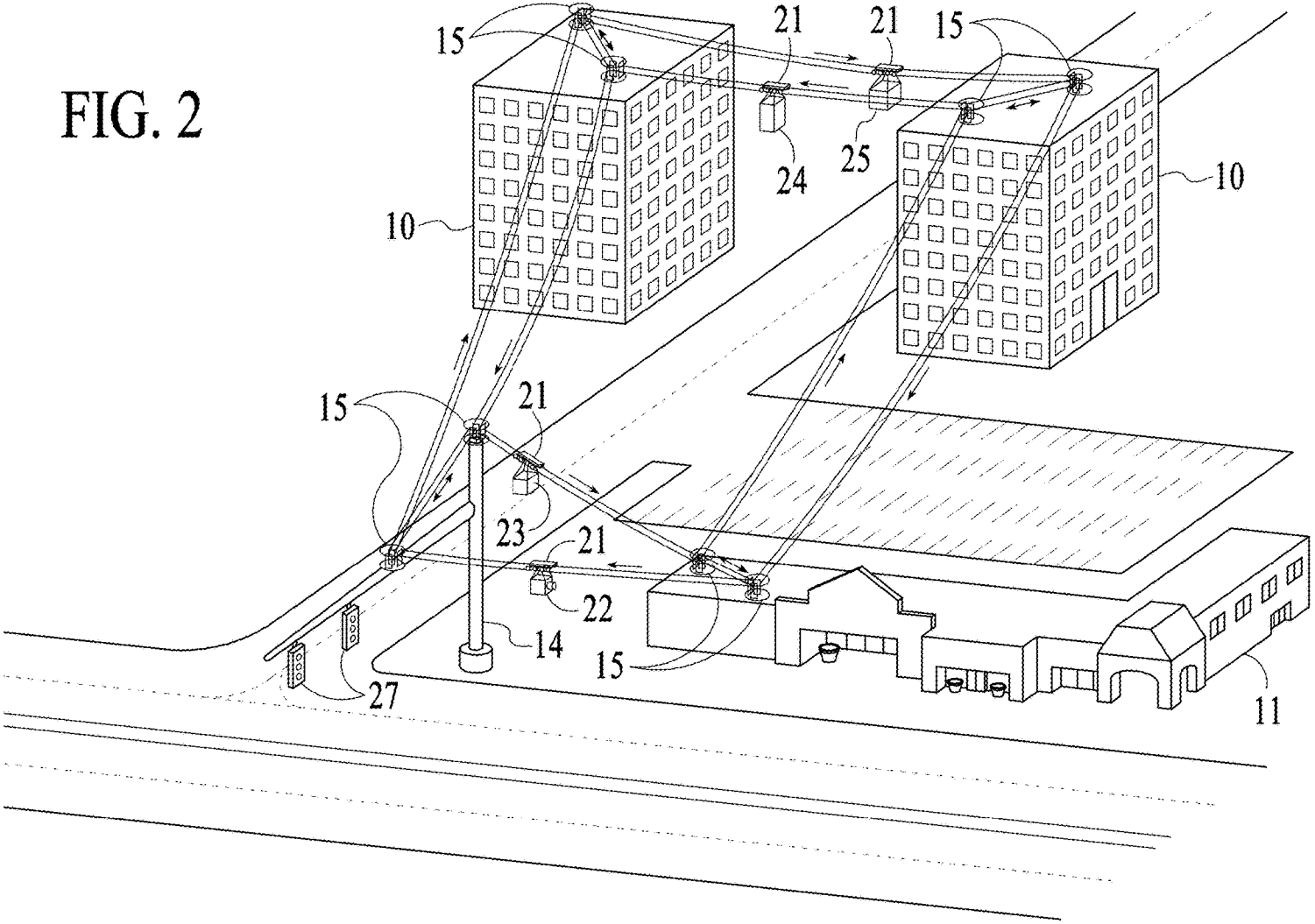
FIG. 2 is a simplified diagram illustrating part of a ropeway vehicle transportation network in accordance with an implementation.

FIG. 2 shows additional detail of a ropeway vehicle transportation network. Stations 15 are shown located on buildings 10, a commercial shopping store/center 11 and a traffic pole 14, which includes traffic lights 27. Travelling within the ropeway vehicle transportation network are ropeway vehicles 21. Each of ropeway vehicles 21 can carry a different payload. Examples of payloads shown in FIG. 2 include a security camera 22 and a grocery package 23 and a delivery package 24 and a delivery package 25. For example, as illustrated in FIG. 2, ropeway vehicles on an outer loop travel in a clockwise direction and ropeway vehicles on an inner loop travel in a counter clockwise direction. At each "node" composed of two stations, ropeway vehicles are able to travel the line between the two stations of the node to move between the inner loop and the outer loop.

Figure 3:
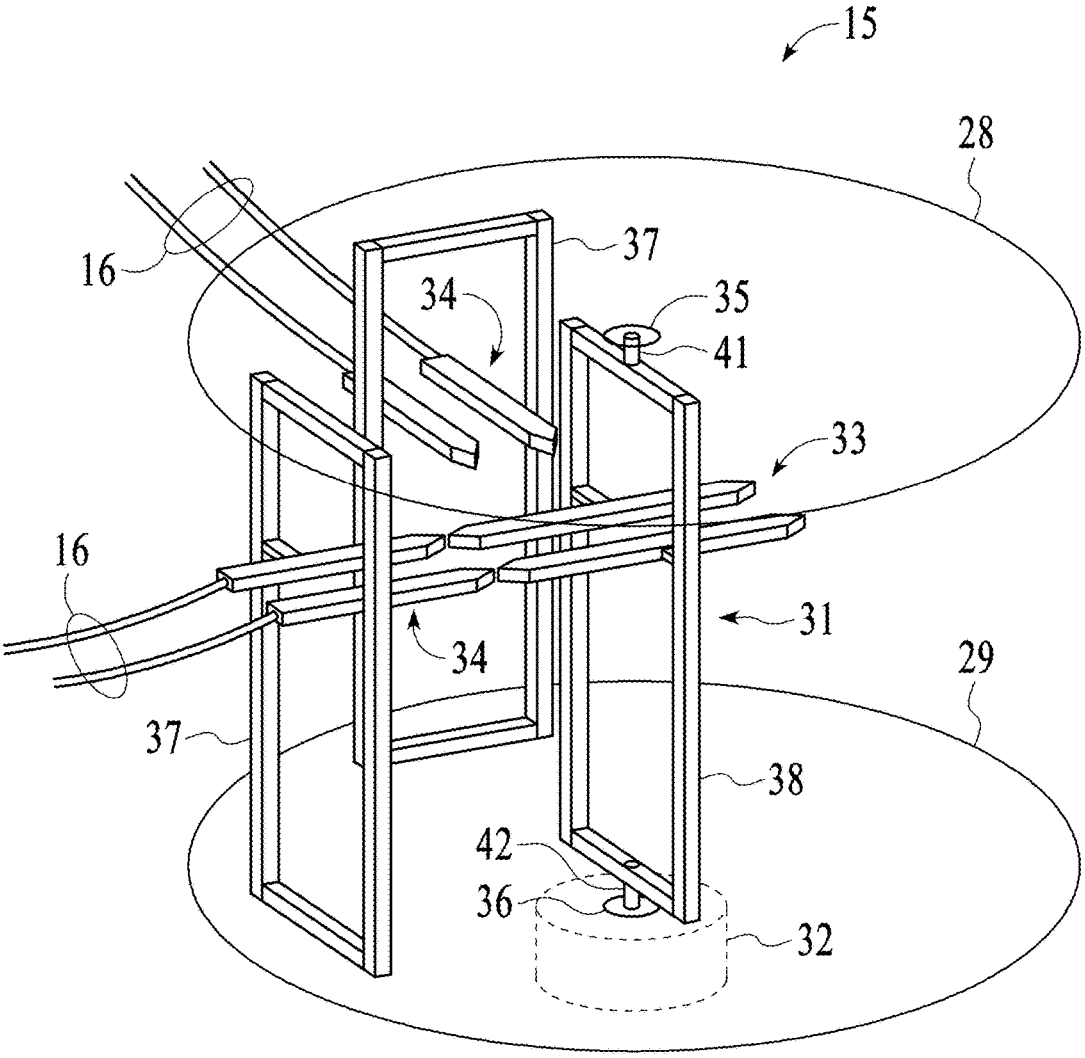
FIG. 3, FIG. 4, FIG. 5, FIG. 6, FIG. 7, FIG. 8, FIG. 9 and FIG. 10 show details of a line changer for a ropeway vehicle transportation network in accordance with an implementation.

FIG. 3 shows additional details of a station 15 that is a line changer station and includes a line changer. Line terminals consist of line terminal rails 34 mounted on line terminal frames 37. Line terminal rails 34 act as end points for ropeway line 16. Line terminal rails 34 mounted on a line terminal frame 37 allow for smooth transition of ropeway vehicles 21 from flexible cable or rope onto shifter rails 33 of a line changer station. A line shifter 31 aligns shifter rails 33 with line terminal rails 34 on which an incoming ropeway vehicle 21 will arrive. Shifter rails 33 are mounted on a shifter frame 38. The incoming ropeway vehicles 21 travels from ropeway line 16 through terminals 34 to shifter rails 33. Line shifter 31 then can rotate to align shifter rails 33 to terminals 34 for an outgoing direction. The outgoing ropeway vehicles 21 travels from shifter rails 33 through line terminal rails 34 to ropeway line 16 in a desired outgoing direction.

For example, line terminal rails 34 and shifter rails 33 do not include an electrical power source and ropeway vehicles 21 rely on battery power when traversing line terminal rails 34 and shifter rails 33. Alternatively, line terminal rails 34 and shifter rails 33 do include an electrical power source and ropeway vehicles 21 rely on this power source when traversing line terminal rails 34 and shifter rails 33.

For example, line terminal rails 34 and shifter rails 33 all include tapering ends to allow smooth transitions of ropeway vehicles 21 as ropeway vehicles 21 enter station 15.

A top cover plate 28 provides a location where station 15 can be attached to a building, a pole or another object. Likewise, a base cover plate 29 provides a location where station 15 can be attached to a building, a pole or another object.

A top bearing 35 attaches a top axel 41 of line shifter 31 to top cover plate 28 and allows rotation of line shifter 31 around a vertical axis. A bottom bearing 36 attaches a bottom axel 42 of line shifter 31 to bottom cover plate 29 and allows rotation of line shifter 31 around the vertical axis. A line shifter controller 32 includes a rotating motor with encoder, sensors and electronics. Line shifter controller 32 controls rotation of line shifter 31. Line shifter controller 32 includes, for example, sensors for checking and maintaining alignment of shifter rails 33 with selected line terminal rails 34 to ensure smooth transitions of ropeway vehicles 21 between shifter rails 33 with selected line terminal rails 34. Alternatively, or in addition, one or both of shifter frame 38 and line terminal frame 37 include sensors for checking and maintaining alignment of shifter rails 33 with selected line terminal rails 34 to ensure smooth transitions of ropeway vehicles 21 between shifter rails 33 with selected line terminal rails 34. Similarly, line terminal rails and shifter rails can also include alignment detection sensors to allow smooth transition of ropeway vehicles between shifter rails and line terminal rails.

Figure 6:
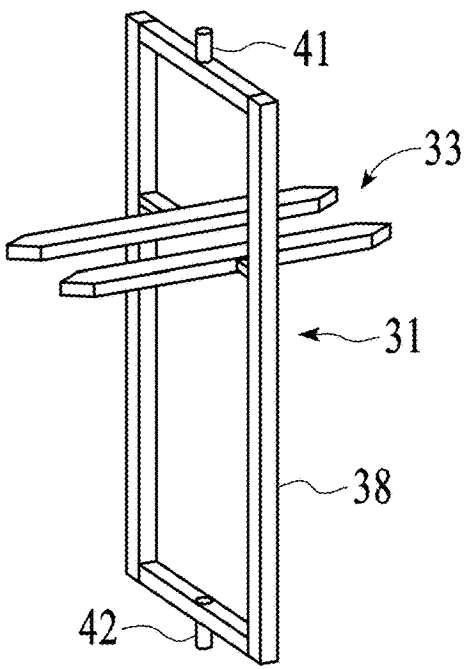
Figure 5:
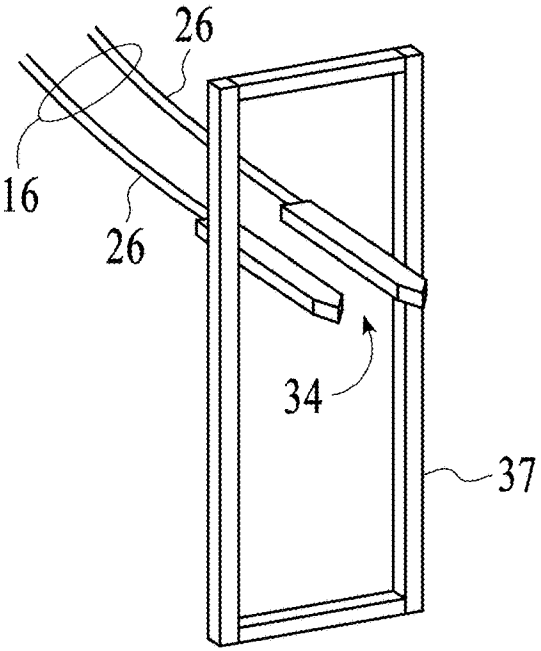
Figure 4:
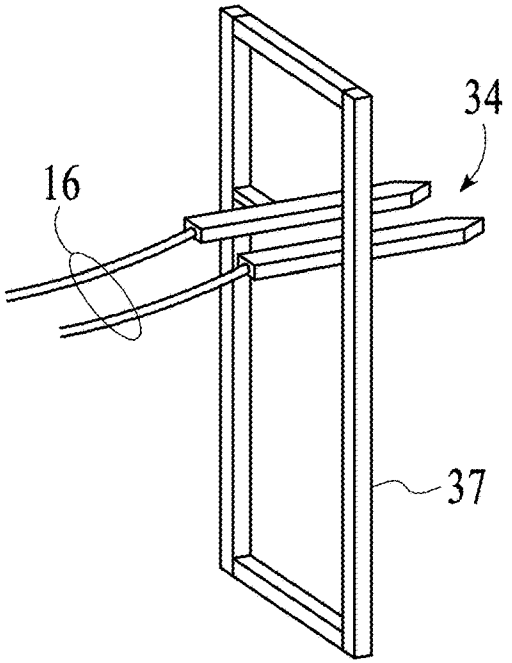

FIG. 4 and FIG. 5 show details of the line terminal consisting of line terminal frame 37 and line terminal rails 34. FIG. 6 shows additional details of line shifter 31. As illustrated by FIG. 4, each line 16 is implemented by a pair of cables 26.

Figure 7:
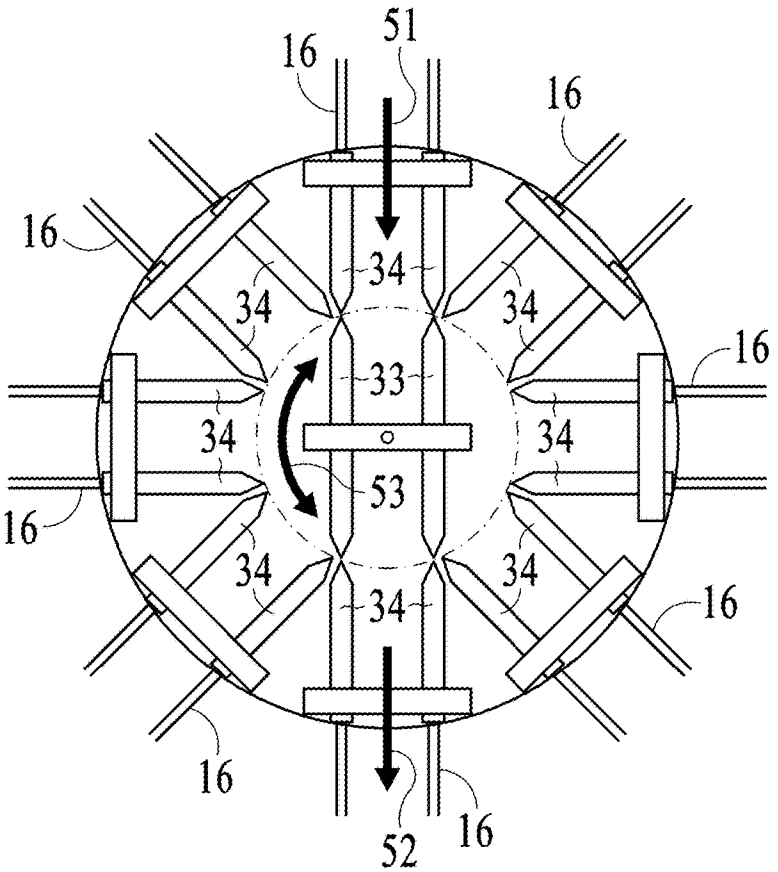

FIG. 7 shows a line changer with eight channels. At each channel, a ropeway line 16 is connected to a pair of line terminal rails 34. Shifter rails 33 are aligned with various pairs of line terminal rails 34 to receive incoming ropeway vehicles 21 and to send out outgoing ropeway vehicles 21. In FIG. 7, arrow 51 represents a direction of an incoming ropeway vehicle 21 that traverses shifter rails 33 to proceed in an outgoing direction represented by arrow 52. Arrow 53 represents possible rotation of shifter rails 33 around a vertical axis.

Figure 8:
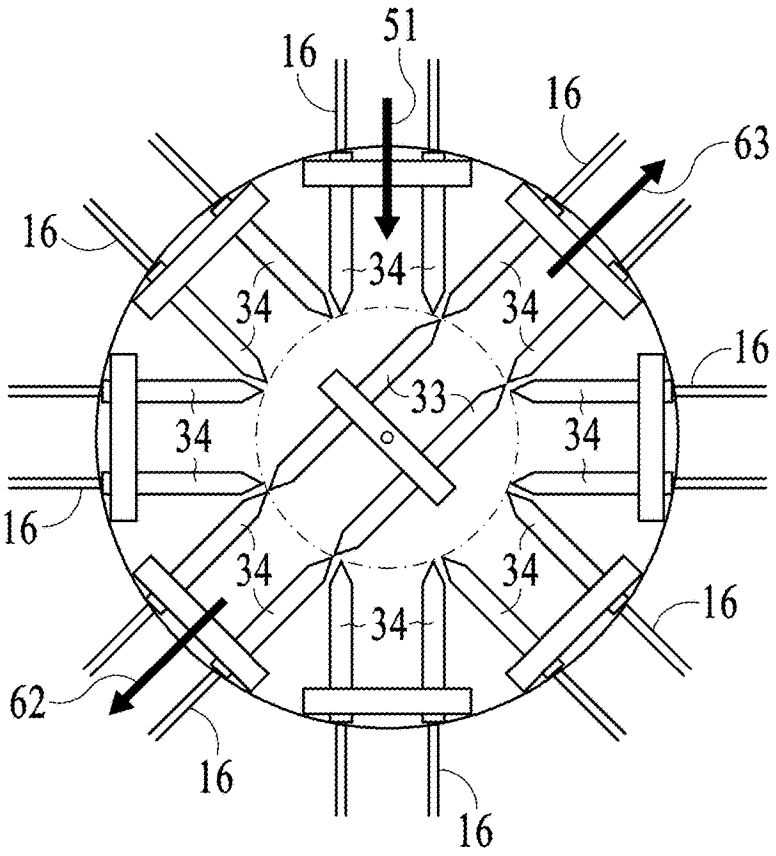

In FIG. 8, arrow 61 and arrow 62 possible outgoing directions for a ropeway vehicle 21 that is ready to exit shifter rails 33.

Figure 10:
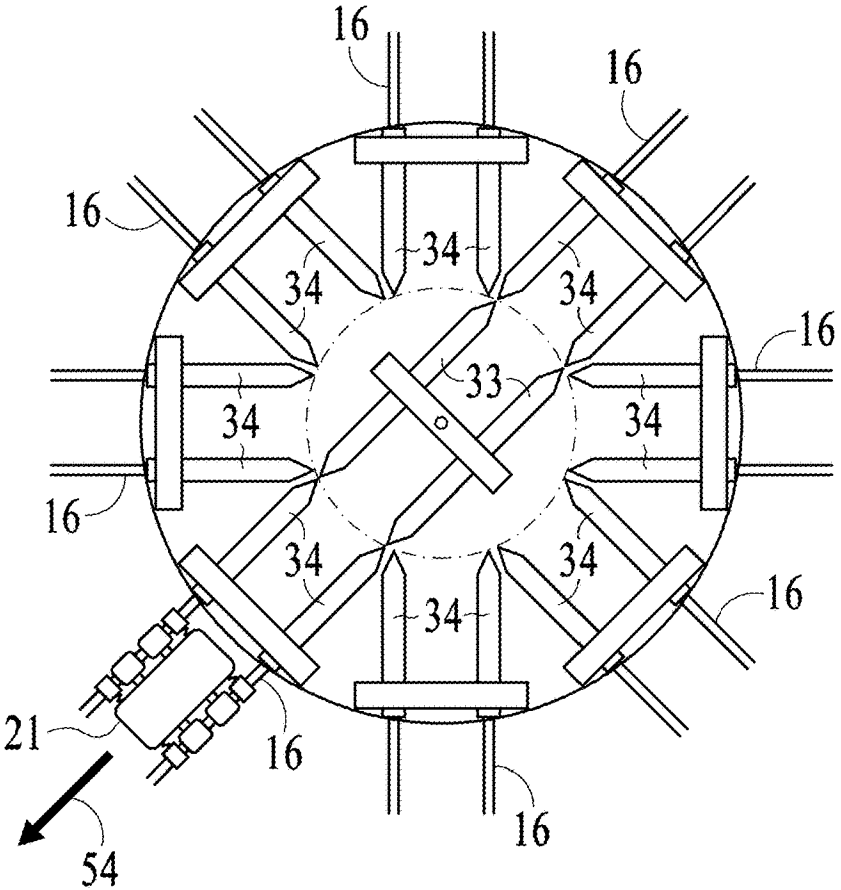
Figure 9:
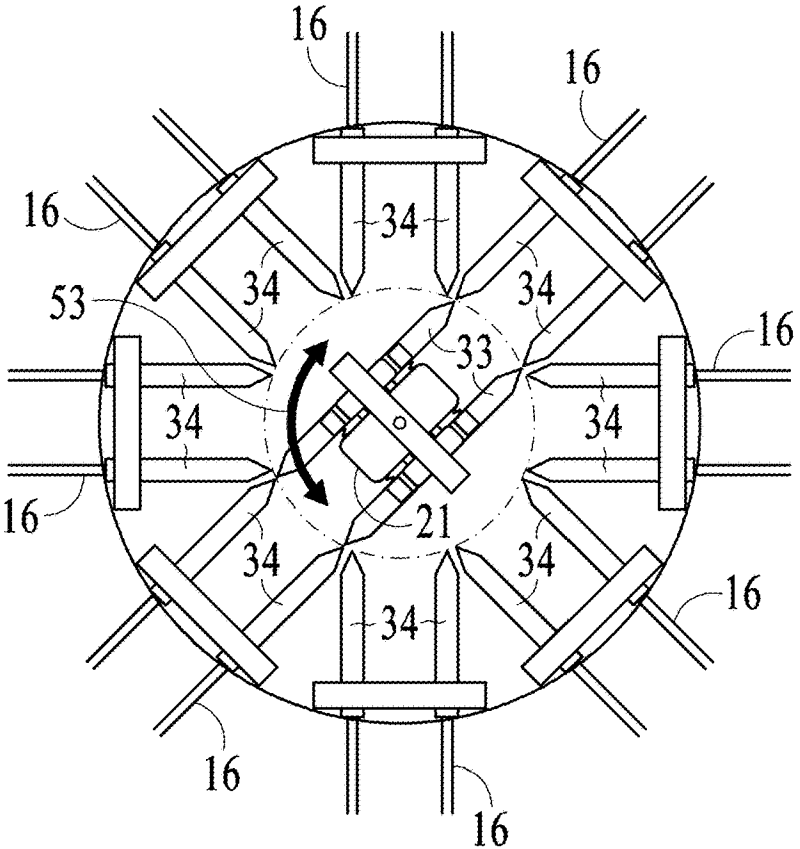

FIG. 9 shows ropeway vehicle 21 on shifter rails 33. Arrow 53 represents possible rotation of shifter rails 33 around a vertical axis. FIG. 10 shows ropeway vehicle 21 exiting station 15 in a direction represented by arrow 54.

The line change in station 15 allows ropeway vehicle 21 to change direction of travel or take a U-turn and return in a same direction that ropeway vehicle entered station 15

FIG. 11, FIG. 12, FIG. 13 and FIG. 14 illustrate how ropeway vehicle 21 utilizes anti-derail confinement clips 75 to secure ropeway vehicle 21 to ropeway cables 26. Anti-derail confinement clips 75 are supported by ropeway vehicle anti-derail confinement clip springs 76, which allow smooth ropeway vehicle navigation over ropeway cables 26 and line changers within stations 15. Ropeway vehicle anti-derail confinement clip springs 76 maintain outward force on ropeway cables 26 during ropeway vehicle navigation. This further prevents ropeway vehicle 21 from de-railing from ropeway cables 26.

Figure 12:
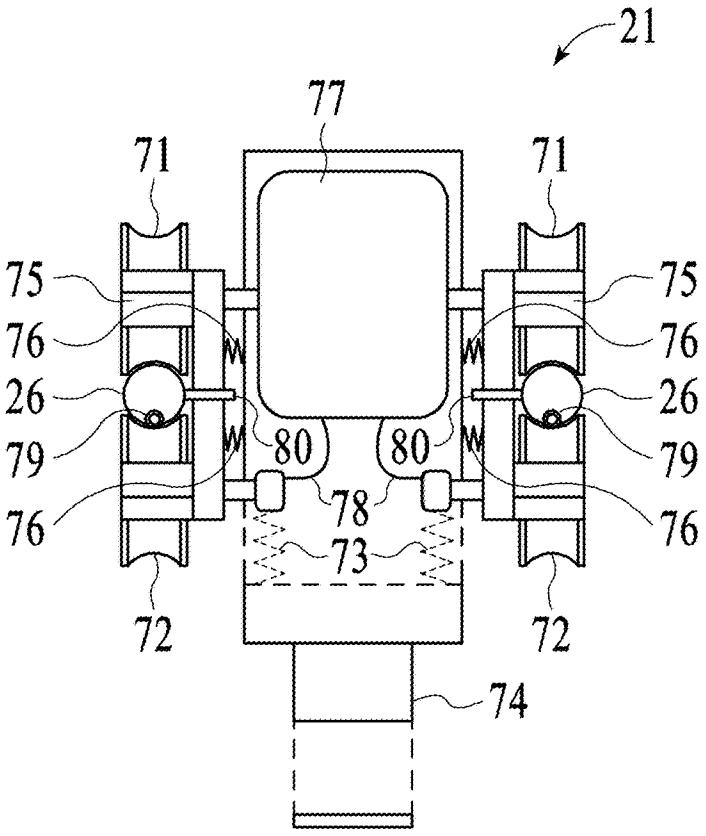
FIG. 11, FIG. 12, FIG. 13 and FIG. 14 show details of a ropeway vehicle in accordance with an implementation.
Figure 11:
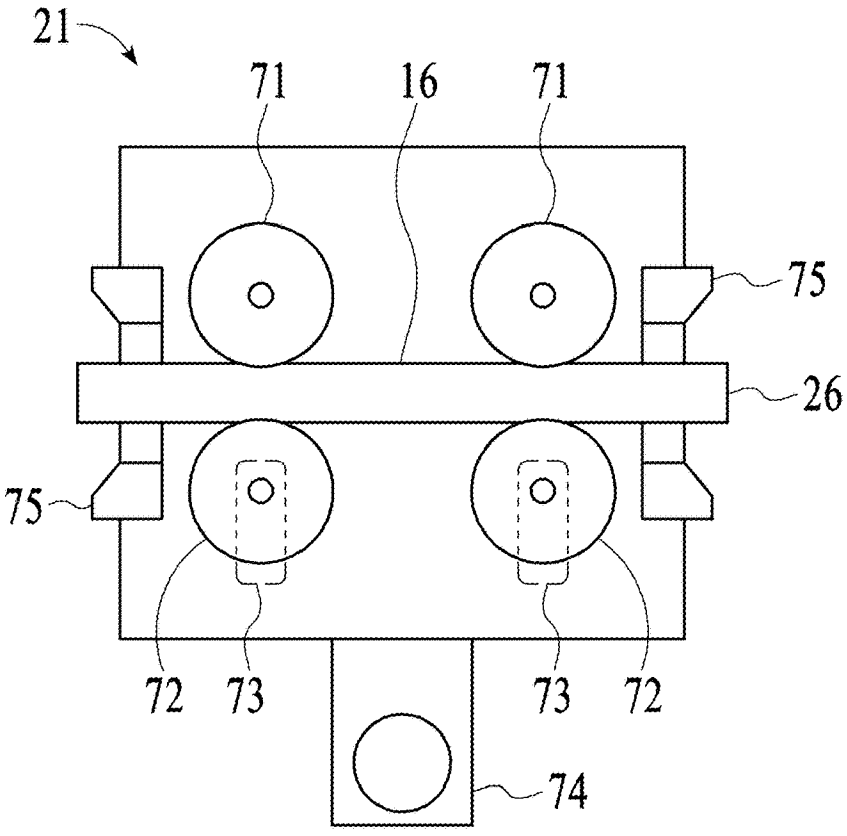

As shown in FIG. 12, ropeway cables 26 each include an electrical cable 79. For each ropeway line 16, one of the ropeway cables 26 has a live wire attached while the other of the ropeway cables 26 has neutral or ground wire attached. Ropeway cables 26 provide paths for ropeway vehicle navigation and support ropeway vehicles 21 plus payloads carried by ropeway vehicles 21. Ropeway cables 26 also power ropeway vehicles 21.

For each of ropeway vehicles 21, at least one of bottom (commutator) wheels 72 is a commutator wheel that draw power from electrical cable 79 attached to ropeway cables 26. Electricity thus drawn through wires 78 is utilized by on-board controller 77 within ropeway vehicles 21 to power upper (drive) wheels 71 using motors and other electronic circuits. For example, on-board controller 77 includes a microprocessor, memory, wireless communication capability, power circuits, on-board battery and so on to power and control ropeway vehicles 21. Also, power drawn from electrical cable 79 through wires 78 is used to charge the on-board batteries. For example, the on-board batteries are used to supply power when ropeway vehicles 21 are within one of stations 15.

Commutator wheels 72 have attached springs 73 that allow tight clamping of ropeway cables 26 between drive wheels 71 and commutator wheels 72. Tight clamping provides sufficient friction for ropeway vehicle to navigate over ropeway cables 26. For example, drive wheels 71 and commutator wheels 72 are concave to form grooves to lock in ropeway cables 26 and to prevent prevent ropeway vehicles 21 from derailing. On one side of ropeway vehicle 21 there is sufficient opening between the concave shape of drive wheels 71 and commutator wheels 72 to allow ropeway vehicle 21 to pass by restraining clamps 101 (shown in FIG. 19) that are used to limit the distance between each of ropeway cables 26 in a ropeway line 16.

While in FIG. 12, the commutator wheels are shown as implemented in different wheels than drive wheels, in other implementations commutator wheels may be implemented as drive wheels so that each wheel has dual functionality including drive and commutation.

Figure 14:
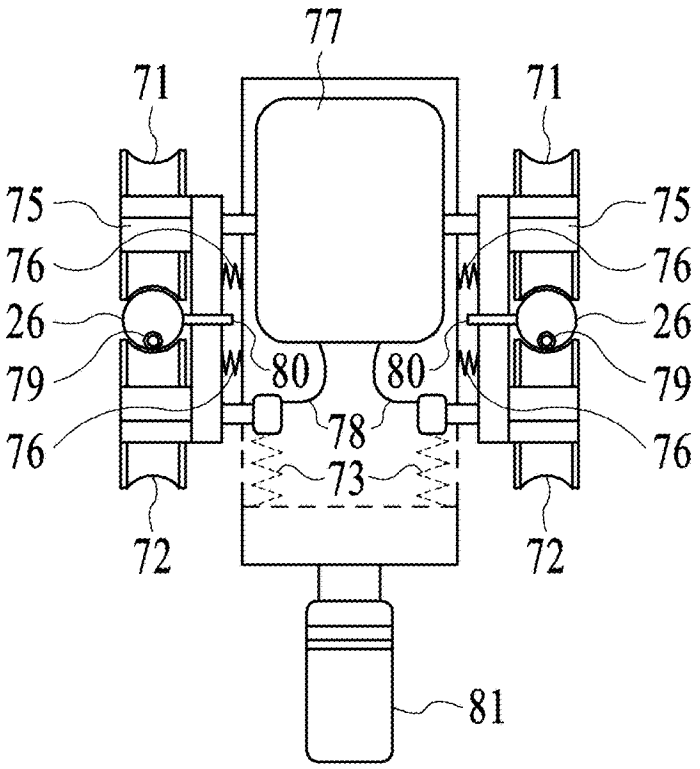
Figure 13:
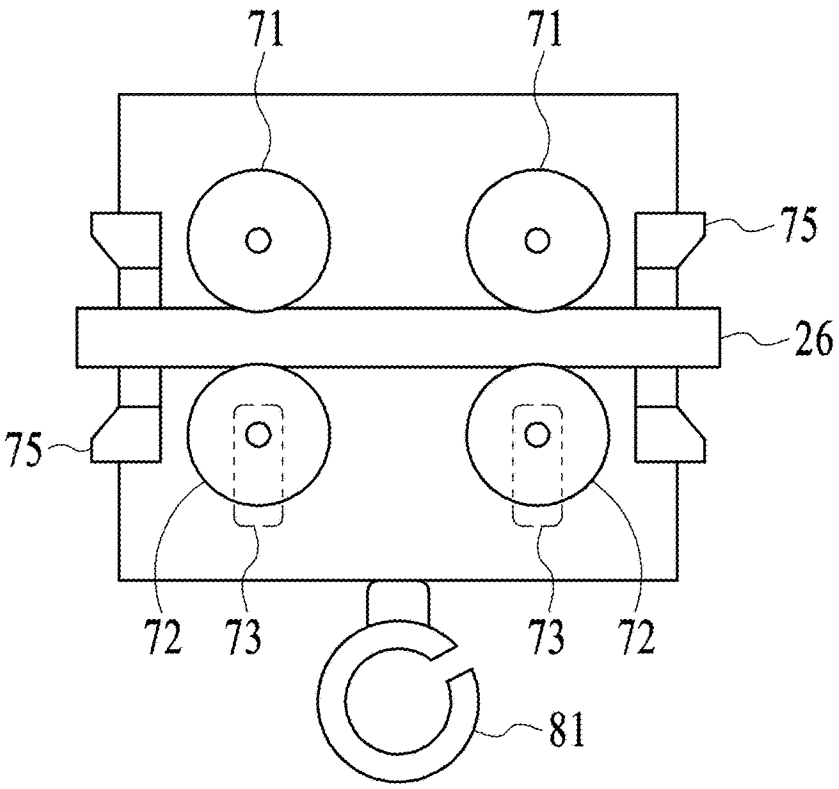
Figure 15:
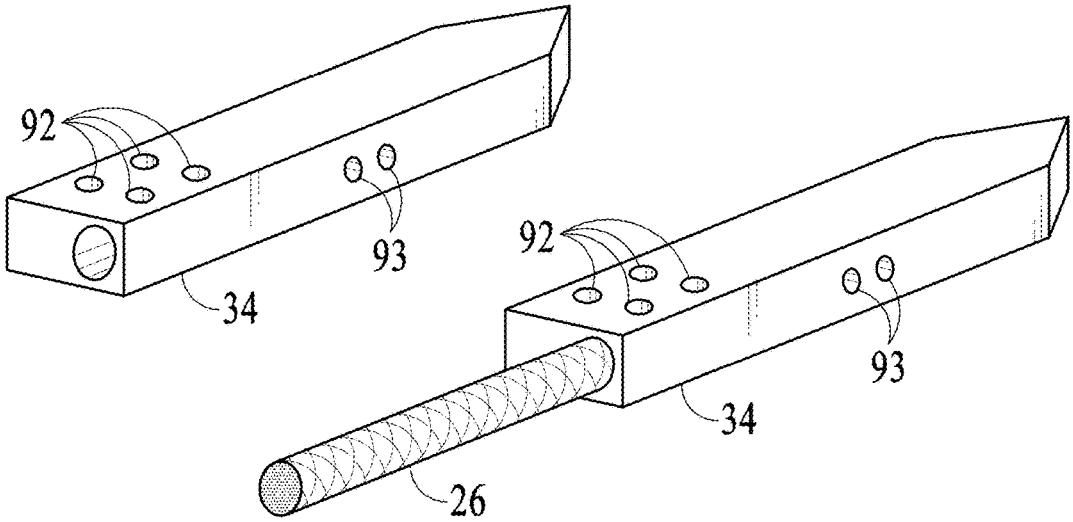
FIG. 15, FIG. 16, FIG. 17 and FIG. 18 show details of a ropeway line to terminal rail joint in accordance with an implementation.
Figure 16:
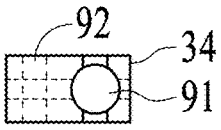
Figure 17:
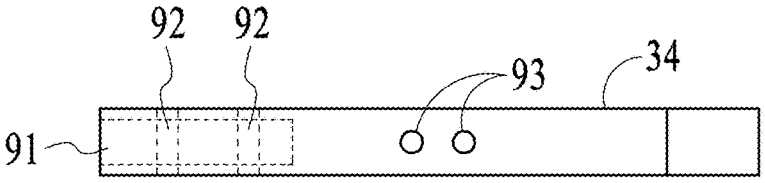
Figure 18:
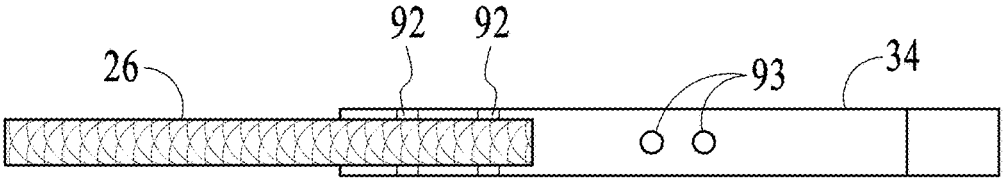

For example, each ropeway vehicle 21 includes an attachment port 74. Attachment port 74 allows attachment of different types of payloads to ropeway vehicles 21. An attachment port 81, shown in FIGS. 13 and 14, is another implementation illustrating one of various shapes that can be used for an attachment port.

Additional wheels 80 may be mounted on anti-derail confinement clips 75 to reduce friction by rolling over ropeway cables 26 when ropeway vehicles 21 travel. This prevents ropeway vehicles 21 from derailing by maintaining an outward clip induced force on ropeway cables 26.

FIG. 15, FIG. 16, FIG. 17 and FIG. 18 show details of line terminal rails 34 and how line terminal rails 34 are connected to ropeway cables 26. For example, a ropeway cable 26 is placed within a hole 91 of a terminal rail 34. Holes 92 are used to secure ropeway cable 26 within hole 91 of terminal rail 34. This is done, for example, using one or a combination of tie wrap, belts, flexible members, small ropes, screws, or a similar fastening device to secure ropeway cable 26 within hole 91 of terminal rail 34. Holes 93 are used, for example, to secure line terminal rails 34 to line terminal frames 37, shown in FIG. 3. This is done, for example, using one or a combination of tie wrap, belts, flexible members, small ropes, screws, or a similar fastening device.

Line terminal rails 34 have tapering ends to allow smooth transition of ropeway vehicle 21 over adjacent rails by preventing the anti derail confinement clip 75 (shown in FIG. 11) from getting stuck when ropeway vehicle 21 travels between line terminal rails 34 and shifter rails 33, as shown in FIG. 3.

Figure 19:
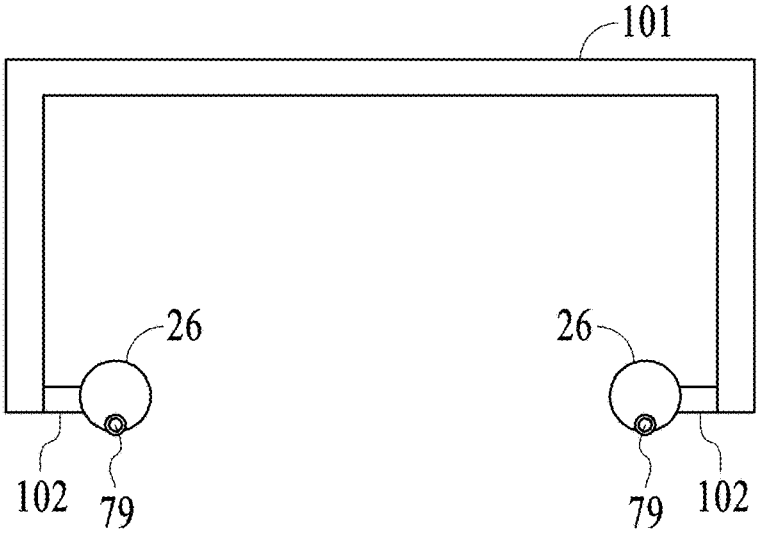
FIG. 19 shows a line restraining clamp in accordance with an implementation.

FIG. 19 shows a line restraining clamp 101 that is used at locations throughout ropeway vehicle transportation network system 1 (shown in FIG. 1). Line restraining clamps are attached to cables at varying intervals to keep each pair of the ropeway cables 26 relatively parallel to prevent derailment of ropeway vehicle 21. Line restraining clamps allow smooth unhindered travel of ropeway vehicle 21 on ropeway cables 26. For example, ropeway cables 26 is attached to line restraining clamp 101 at a location 102 using tie wraps, belts, ropes, flexible members, screws, or some other appropriate fastening device. As discussed above, on one side of ropeway vehicle 21 there is sufficient opening between the concave shape of drive wheels 71 and commutator wheels 72 to allow ropeway vehicle 21 to pass by the restraining clamps 101. The sideways attachment point at location 102 provides clearance for ropeway vehicle to travel through the restraining clamp structure without hindrance. For example, line restraining clamp 101 is made of non-conducting-stiff material that holds the two ropeway cables in a ropeway pair parallel and equidistant with respect to each other.

The foregoing discussion discloses and describes merely exemplary methods and embodiments. As will be understood by those familiar with the art, the disclosed subject matter may be embodied in other specific forms without departing from the spirit or characteristics thereof. Accordingly, the present disclosure is intended to be illustrative, but not limiting, of the scope of the invention, which is set forth in the following claims.

What is claimed is:

1. A ropeway vehicle used for traversing ropeway lines connecting network stations, the ropeway vehicle comprising:

at least one power drive wheel that is powered to move the ropeway vehicle along the ropeway lines;

at least one commutator wheel that draws electrical power from ropeway cables that form the ropeway lines; and, a controller that includes an on-board battery to back-up and supplement electrical power obtained from the ropeway cables;

wherein the at least one power drive wheel and the at least one commutator wheel are each concave to form grooves to lock in ropeway lines and prevent derailing and wherein on one side of the ropeway vehicle there is sufficient opening between the at least one power drive wheel and the at least one commutator wheel to allow the ropeway vehicle to pass by restraining clamps used to limit distance between the ropeway cables that form the ropeway lines.

2. A ropeway vehicle as in claim 1 wherein the at least one power drive wheel includes two wheels on a first side of the ropeway vehicle and two wheels on a second side of the ropeway vehicle.

3. A ropeway vehicle as in claim 1 wherein the at least one commutator wheel includes two wheels on a first side of the ropeway vehicle and two wheels on a second side of the ropeway vehicle.

4. A ropeway vehicle as in claim 1 wherein at least one spring provides force on the at least one commutator wheel to provide tight clamping of the at least one commutator wheel to the ropeway cables attached to the ropeway lines.

5. A ropeway vehicle as in claim 1, additionally comprising:

an attachment port for carrying a payload.

6. A ropeway vehicle as in claim 5, wherein the payload is any combination of a security camera, a weather sensor, a delivery package, building materials, groceries, medicine, agricultural payloads and supplies.

7. A ropeway vehicle as in claim 1, wherein for each ropeway line the ropeway vehicle includes an anti-derail confinement clip that includes a wheel that maintains outward force on the ropeway line as the ropeway vehicle moves along the ropeway lines.

8. A ropeway vehicle as in claim 1, wherein the controller includes a microprocessor, memory and wireless communication capability.

9. A ropeway vehicle as in claim 1, wherein wires connect the controller to the at least one commutator wheel.

10. A ropeway vehicle as in claim 1, wherein for each ropeway cable of a ropeway line the ropeway vehicle includes:

an anti-derail confinement clip and spring system that maintains outward force on the ropeway line as the ropeway vehicle moves along the ropeway lines.

11. A ropeway vehicle used within a ropeway vehicle transportation network, the ropeway vehicle comprising:

a first power drive wheel that is powered to move the ropeway vehicle along a first ropeway line;

a second power drive wheel that is powered to move the ropeway vehicle alone a second ropeway line;

a first commutator drive wheel that draws electrical power from a first ropeway cables that forms the first ropeway lines; and a second commutator drive wheel that electrically connects to a second ropeway cable that forms the second ropeway line so as to complete a circuit with the electrical power from the first ropeway cable;

wherein there is sufficient opening between the first power drive wheel and the first commutator wheel to allow the ropeway vehicle to pass by restraining clamps used to limit distance between the first ropeway cable and the second ropeway cable.

12. A ropeway vehicle as in claim 11, additionally comprising:

a third power drive wheel on a first side of the ropeway vehicle; and a fourth power drive wheel on a second side of the ropeway vehicle.

13. A ropeway vehicle as in claim 12, additionally comprising:

a third commutator wheel on the first side of the ropeway vehicle; and a fourth commutator wheel on the second side of the ropeway vehicle.

14. A ropeway vehicle as in claim 11, wherein the ropeway vehicle includes an anti-derail confinement clip that includes a wheel that maintains outward force on the first ropeway line as the ropeway vehicle moves along the first ropeway line.

15. A ropeway vehicle as in claim 11, wherein the first power drive wheel and the first commutator wheel are each concave to form grooves to lock in the first ropeway line and prevent derailing.

16. A ropeway vehicle used within a ropeway vehicle transportation network, the ropeway vehicle comprising:

at least one power drive wheel that is powered to move the ropeway vehicle along ropeway lines;

at least one commutator drive wheel that draws electrical power from ropeway cables that form the ropeway lines;

a controller that includes an on-board battery to back-up and supplement electrical power obtained from the ropeway cables; and, an anti-derail confinement clip and spring system that maintains outward force on the ropeway line as the ropeway vehicle moves along the ropeway lines.

17. A ropeway vehicle as in claim 16, wherein the at least one power drive wheel and the at least one commutator wheel are each concave to form grooves to lock in ropeway lines and prevent derailing.

18. A ropeway vehicle as in claim 16, wherein the at least one power drive wheel and the at least one commutator wheel are each concave to form grooves to lock in ropeway lines and prevent derailing and wherein on one side of the ropeway vehicle there is sufficient opening between the at least one power drive wheel and the at least one commutator wheel to allow the ropeway vehicle to pass by restraining clamps used to limit distance between the ropeway cables that form the ropeway lines.

19. A ropeway vehicle as in claim 16, additionally comprising:

an attachment port for carrying a payload.

20. A ropeway vehicle as in claim 19, wherein the payload is any combination of a security camera, a weather sensor, a delivery package, building materials, groceries, medicine, agricultural payloads and supplies.

* * * * *